US011761048B2

(12) United States Patent
Liao et al.

(10) Patent No.: US 11,761,048 B2
(45) Date of Patent: Sep. 19, 2023

(54) METHOD FOR TREATING AND PHOSPHATIZING METAL BOARD WITHOUT USING ACID

(71) Applicant: KUNSHAN AIRBAG PACKING CORP., Kunshan (CN)

(72) Inventors: Tai-An Liao, New Taipei (TW); Kao-Hsiung Liao, New Taipei (TW); Ping-Yuan Liao, New Taipei (TW); Tsai-Ming Kuo, New Taipei (TW)

( * ) Notice: Subject to any disclaimer, the term of this patent is extended or adjusted under 35 U.S.C. 154(b) by 368 days.

(21) Appl. No.: 17/079,621

(22) Filed: Oct. 26, 2020

(65) Prior Publication Data

US 2021/0123113 A1 Apr. 29, 2021

(30) Foreign Application Priority Data

Oct. 29, 2019 (TW) ..... 108139104

(51) Int. Cl.

| | |
|---|---|
| ***C21D 7/06*** | (2006.01) |
| ***B24C 11/00*** | (2006.01) |
| ***C23C 22/12*** | (2006.01) |
| ***C23C 22/77*** | (2006.01) |
| ***C23G 5/06*** | (2006.01) |
| ***C23C 22/78*** | (2006.01) |
| ***C23C 22/18*** | (2006.01) |

(52) U.S. Cl.

CPC ..... *C21D 7/06* (2013.01); *B24C 11/00* (2013.01); *C23C 22/12* (2013.01); *C23C 22/18* (2013.01); *C23C 22/77* (2013.01); *C23C 22/78* (2013.01); *C23G 5/06* (2013.01)

(58) Field of Classification Search

CPC ... C23C 22/07–23; C23C 22/73; C23C 22/77; C23C 22/78; B24C 11/00; C21D 7/06; C23G 5/06

See application file for complete search history.

(56) References Cited

FOREIGN PATENT DOCUMENTS

| | | | | |
|---|---|---|---|---|
| CN | 1394239 | * | 1/2003 | ..... C23C 2/26 |
| CN | 108277487 | * | 7/2018 | ..... C23C 22/17 |

* cited by examiner

*Primary Examiner* — Lois L Zheng

(74) *Attorney, Agent, or Firm* — Li & Cai Intellectual Property (USA) Office

(57) ABSTRACT

A method for treating and phosphatizing a metal board without using acid includes the following steps: performing a degreasing step to remove grease and dirt from a surface of the metal board with a degreasing agent; performing a blast-peening step by blasting and peening polygon blast-peening granules on the metal board through a centrifugal impeller to remove an oxidized layer; performing a washing step to clean remaining powders from the metal board after the blast-peening step; performing a phosphatizing step to form a protective phosphate coating on the metal board; performing another washing step to wash off remaining phosphatizing agents from the metal board; performing a rustproofing step to apply a rustproofing agent on the metal board; and performing a drying step to dry the metal board.

9 Claims, 6 Drawing Sheets

METHOD FOR TREATING AND PHOSPHATIZING METAL BOARD WITHOUT USING ACID

CROSS-REFERENCE TO RELATED PATENT APPLICATION

This application claims the benefit of priority to Taiwan Patent Application No. 108139104, filed on Oct. 29, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a method for treating and phosphatizing a metal board without using acid, and more particularly to a metal processing method for removing an oxidized layer from a surface of a metal work piece without using acid, providing a suitable surface for subsequent phosphatizing step that processes a surface of a metal board for being suited for subsequent metal processing.

BACKGROUND OF THE DISCLOSURE

With the rapid development of the metal processing industry, the railway production industry, and the automotive industry, various metal products, railways, and automobile components and products are required to be produced with higher quality. It has been proven through long-term practice that, using a simplified pretreatment process can no longer satisfy the basic requirements for metal processing and coating. Only by using a standard pretreatment production technique can a standard phosphate coating and protecting film be formed on a surface of steel, thereby satisfying the requirements of quality in metal processing and coating treatment.

During processing of steel products, an oxidized skin and rust on a surface of the steel products has to be washed and processed chemically, such that a main body of steel is exposed from the steel products, and effects of treatment such as electroplating, phosphatizing, oxidation (i.e., bluing), stretching, calendering, rolling, and rustproofing are improved.

Currently, the most common manner of chemical rust removal is performed by using hydrochloric acid, since hydrochloric acid works fast in removing rusts and can be used in room temperature, thereby allowing hydrochloric acid to have a wide range of application. However, in actual operations, hydrochloric acid rust removal may result in "over-corrosion", oxidation spots, and "hydrogen embrittlement", and generate large amounts of acid fog, which pollutes the environment and causes harm to the society. Hydrogen embrittlement refers to a phenomenon of an embrittlement that occurs in a process of acid washing a metallic material, in the hydrogen-containing solution, mechanical performances of the metallic material is degraded due to hydrogen absorption or hydrogen permeation.

Therefore, it has become an important issue in this technical field to prevent pollution of the environment and societal harm, through improvement of the treatment method and overcoming the above-mentioned disadvantages.

SUMMARY OF THE DISCLOSURE

In response to the above-referenced technical inadequacies, the present disclosure provides a method for treating and phosphatizing a metal board without using acid, and more particularly to a metal processing method for removing an oxidized layer from a surface of a metal work piece without using acidic solutions, providing a suitable surface for the subsequent phosphatizing step that processes a surface of a metal board for being suited for subsequent metal processing.

In one aspect, the present disclosure provides a method for treating and phosphatizing a metal board without using acid, including:

performing a degreasing step by providing a degreasing agent to remove grease and dirt from a surface of the metal board;

performing a blast-peening step by blasting and peening polygon blast-peening granules on the surface of the metal board through centrifugal impellers to remove an oxidized layer;

performing a washing step to wash the surface of the metal board, thereby removing powders generated from the blast-peening step;

performing a phosphatizing step to form a phosphate coating on the surface of the metal board, so as to provide protection;

performing another washing step to wash off remaining phosphatizing agents from the metal board;

performing a rustproofing step to apply a rustproofing agent on the metal board; and performing a drying step to dry the metal board.

An advantageous effect of the present disclosure is that, by providing the technical solutions of blast-peening to replace conventional manner of acid wash to remove oxidized layers of a metal work piece, the pollution to environments from acid wash solutions is reduced. In the blast-peening step of the present disclosure, the blast-peening granule can be recycled and reused, thereby assisting in protecting the environment. Moreover, an angle and distance of blast-peening are preferably controllable in the present disclosure, and the present disclosure further includes a surface real-time observation step, a detector is used to detect a status of removing the oxidized layer from the surface of the metal board in real-time, and when the powder generated from removing the oxidized layer show a characteristic in the air different from a characteristic from the beginning of the blast-peening step, the blast-peening step is stopped. Therefore, removal of the oxidized layer can be precisely controlled to achieve adequate rust removal and adequate activation on the surface of the metal work piece, for subsequently forming a well-conditioned phosphate coating crystal.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
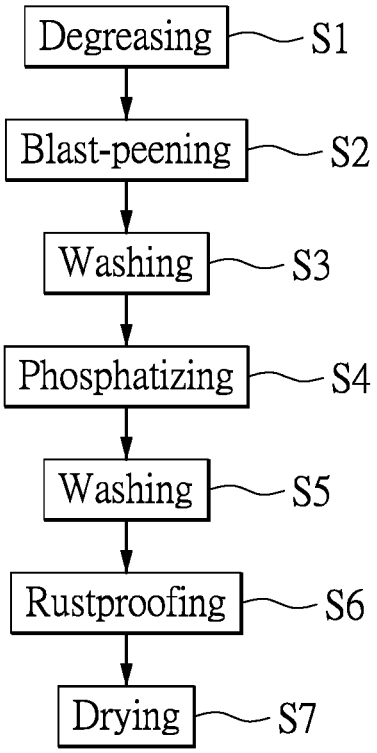
FIG. 1 is a flow chart of steps of a method of the present disclosure for treating and phosphatizing a metal board without using acid.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Reference is made to FIG. 1, which is a flow chart of steps of a method of the present disclosure for treating and phosphatizing a metal board without using acid. The present disclosure provides the method for treating and phosphatizing a metal board without using acid, but the method of the present disclosure is not limited to metal boards, and can be applied to various types of metal work pieces. However, implementations of the method of the present disclosure need further consideration in order to match different shapes of metal work pieces. The method for treating and phosphatizing a metal board without using acid in the present embodiment includes the following steps.

Firstly, a degreasing step S1 is performed, the goal thereof being to remove grease and dirt from a surface of the metal board by providing a degreasing agent. In a pretreatment of surface of metal, degreasing is a crucial step. In the manufacturing and processing of a metal board, some grease and dirt are remained on the metal board, in addition, during the process of storage and transportation, rustproofing oil is applied for rustproofing. Before performing a surface treatment on a surface of a metal board, grease and dirt on the surface need to be washed off, or effects of rust removal and removing oxidized skin will be reduced, and further affecting qualities of surface electroplating and painting layer.

Effect of degreasing is related to four factors, which are the degreasing temperature, degreasing time, mechanical effect, and degreasing agent. Generally, the higher the temperature, the lower the adherence of grease and dirt, and grease and dirt are easier to be removed. In terms of the degreasing time, the metal board of the present disclosure is suitable for a high pressure showering manner for approximately 1.5 to 3 minutes, depending on the type and remaining amount of grease and dirt. However, the present disclosure is not limited thereto, and a dip degreasing manner may also be used, or using the high-pressure showering manner in conjunction with the dip degreasing manner During the process of degreasing, a degreasing effect may be improved with mechanical effects such as pressure spraying or stirring, and during spraying, fresh degreasing agents may come in contact with the surface of the metal board, thereby improving the degreasing effect. For enhancing the emulsification and dispersion effect of the degreasing agent on the grease and dirt, the amount of surface active agents may be increased in the degreasing agent of the present disclosure. When needed, after the degreasing step S1 of the present disclosure, a washing step may be added.

Figure 2:
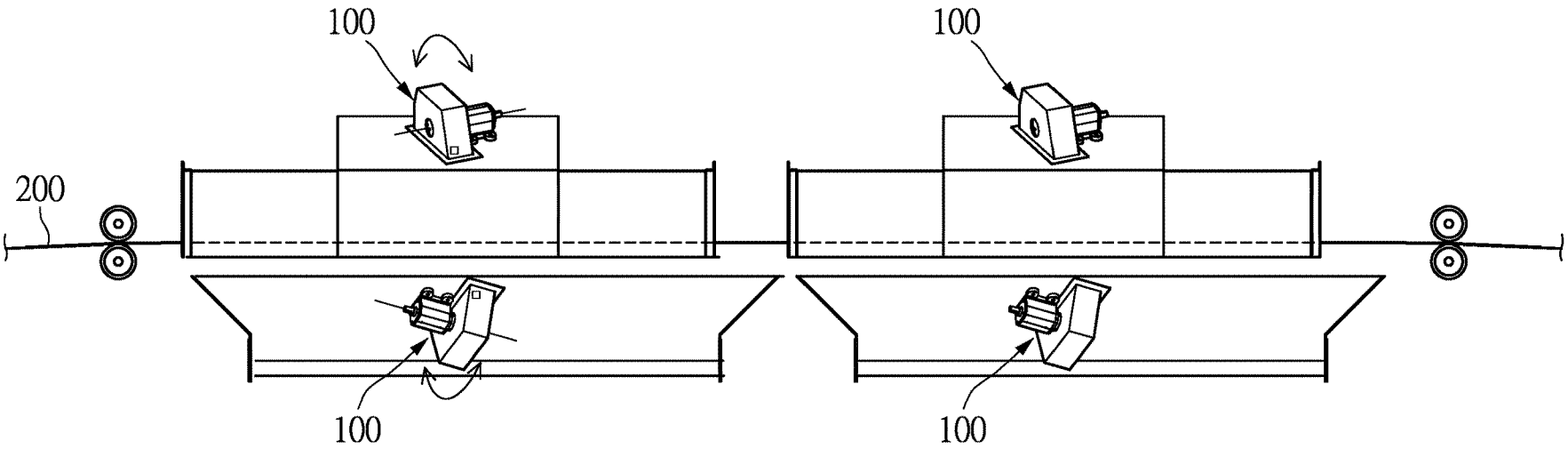
FIG. 2 is a side schematic view of applying a plurality of centrifugal impellers when performing a blast-peening step on the metal board in the present disclosure.
Figure 3:
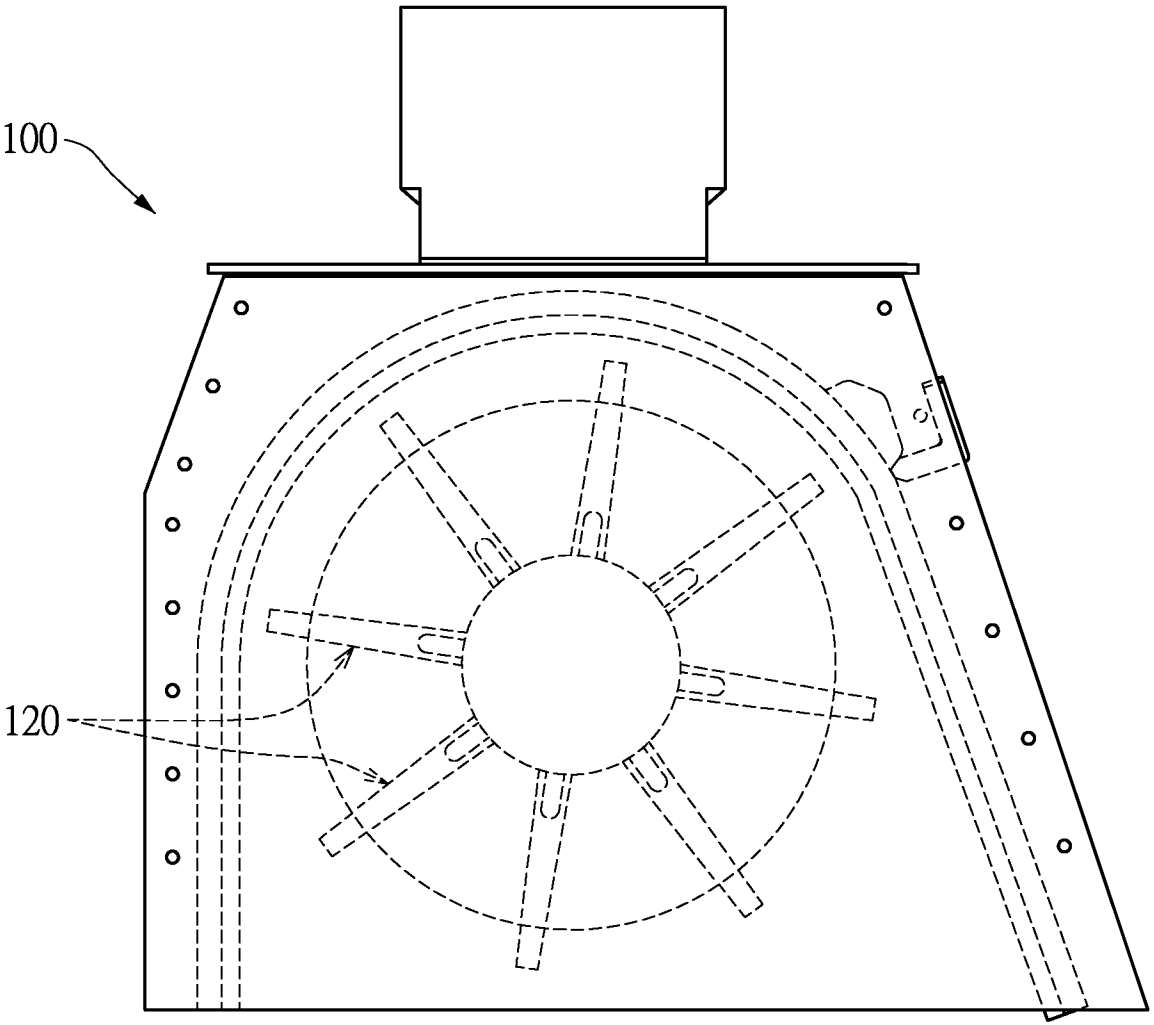
FIG. 3 is a schematic view of the centrifugal impeller blast-peening the metal board in the present disclosure.
Figure 4:
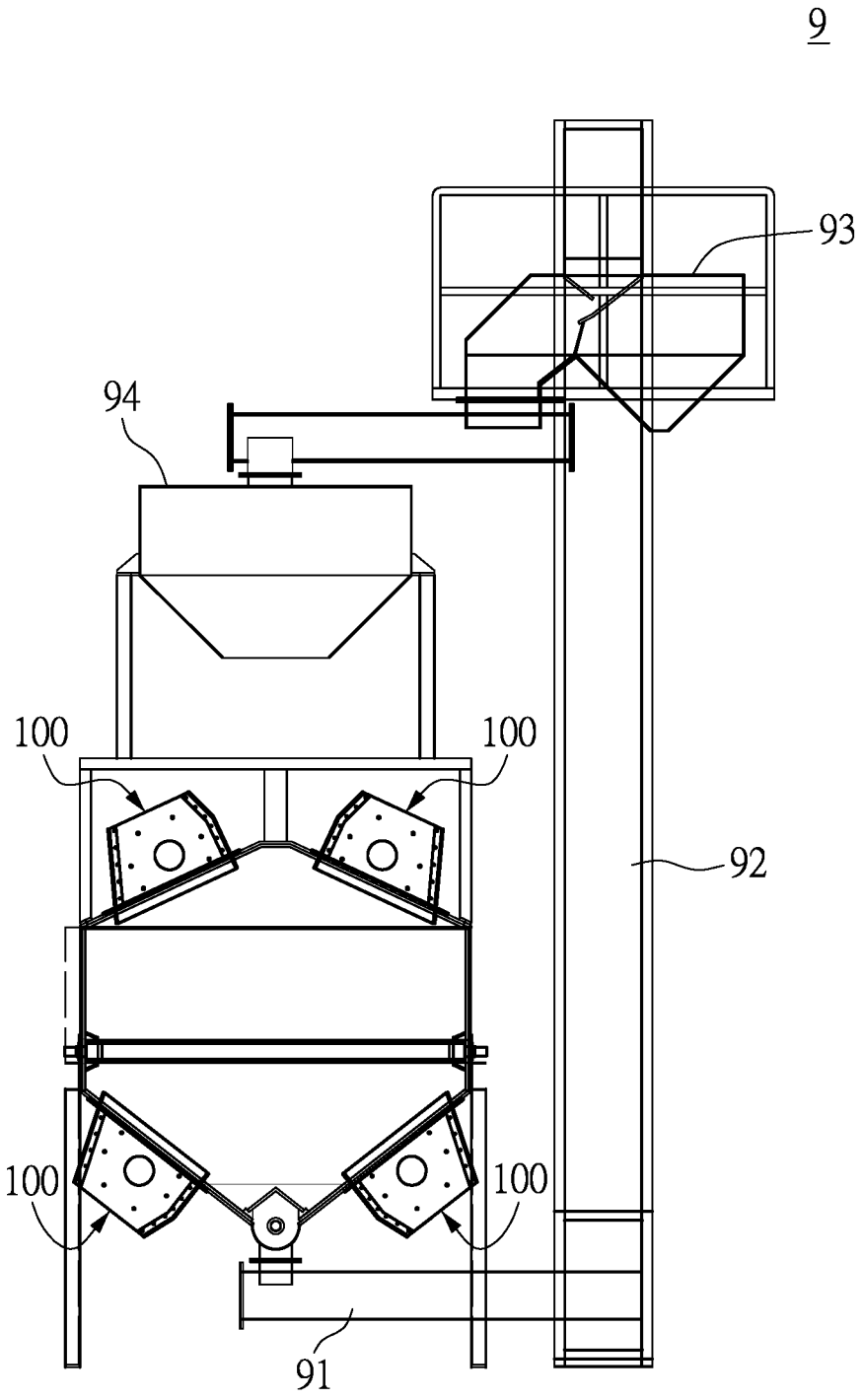
FIG. 4 is a front schematic view of a blast-peening machine used in blast-peening the metal board in the present disclosure.

A blast-peening step S2 is performed, as shown in FIGS. 2 to 4, in which FIG. 2 is a side schematic view of applying a plurality of centrifugal impellers when performing the blast-peening step S2 on a metal board in the present disclosure. Through centrifugal impellers 100, polygon blast-peening granules are blast-peened on the surface of the metal board 200 to remove an oxidized layer. The blast-peening step S2 includes providing the centrifugal impellers 100 and arranging the centrifugal impellers 100 symmetrically at an upper surface and a lower surface of the metal board 200, symmetrically performing blast-peening on the upper surface and the lower surface of the metal board, such that the upper surface and the lower surface of the metal board 200 are symmetrically blast-peened. An advantage of the above-mentioned arrangement is that an upper stress and a lower stress formed from blast-peening counter each other, such that the metal board is maintained flat, and the surface thereof does not have dents or protrusions from a difference in tension.

A feature of the method for treating and phosphatizing a metal board without using acid in the present disclosure is that, a blast-peening machine 9 includes the centrifugal impellers 100 that incorporate the advantages of sandblasting and shot-peening. As shown in FIG. 4, the centrifugal impellers 100 use centrifugal force and shoot blast-peening granules through radial blades 120 at high speed, and a diameter of the blast-peening granules can be between that of sands used in sandblasting and that of beads used in shot-peening. The blast-peening granules can not only clean and increase the roughness of the surface, but can also increase the anti-fatigue robustness and surface harness of the work piece, thereby increasing the lifecycle of the work piece. For example, a speed of blast-peening of the blast-peening step S2 is from 50 to 200 meters per second, the material of the blast-peening granules can be glass, sand or steel, more specifically, such as carborundum or silicon carbide, and a diameter of the blast-peening granules is from 320 to 1400 μm.

Reference is made to FIG. 4, which is a front schematic view of a blast-peening machine used in blast-peening the metal board in the present disclosure. The blast-peening machine 9 includes two pairs of the centrifugal impellers 100 that are disposed at an interval, and two of the centrifugal impellers 100 may be disposed on different planes, or disposed on the same plane. An obtuse angle is formed between two blast-exiting planes (i.e., nozzles), which is approximately from 120 to 150 degrees. Simply speaking, the blast-peening machine 9 includes particle processing equipment 93, the plurality of centrifugal impellers 100, collecting equipment 91, feeding parts 94 and a lifting equipment 92. Through the collecting equipment 91 and the lifting equipment 92, the blast-peening granules may be recycled and reused, which assists in protecting the environment. The particle processing equipment 93 processes the recycled blast-peening granules and filters out other dust or granules mixed therein, and provides the blast-peening granules to the plurality of centrifugal impellers 100 through the feeding parts 94, thus forming a recycling manner to use the blast-peening granules. Details of the blast-peening machine may be referred to in Taiwan Patent Application No. 108132992, filed on Sep. 12, 2019, and the contents thereof may be taken as part of the present disclosure.

Figure 5:
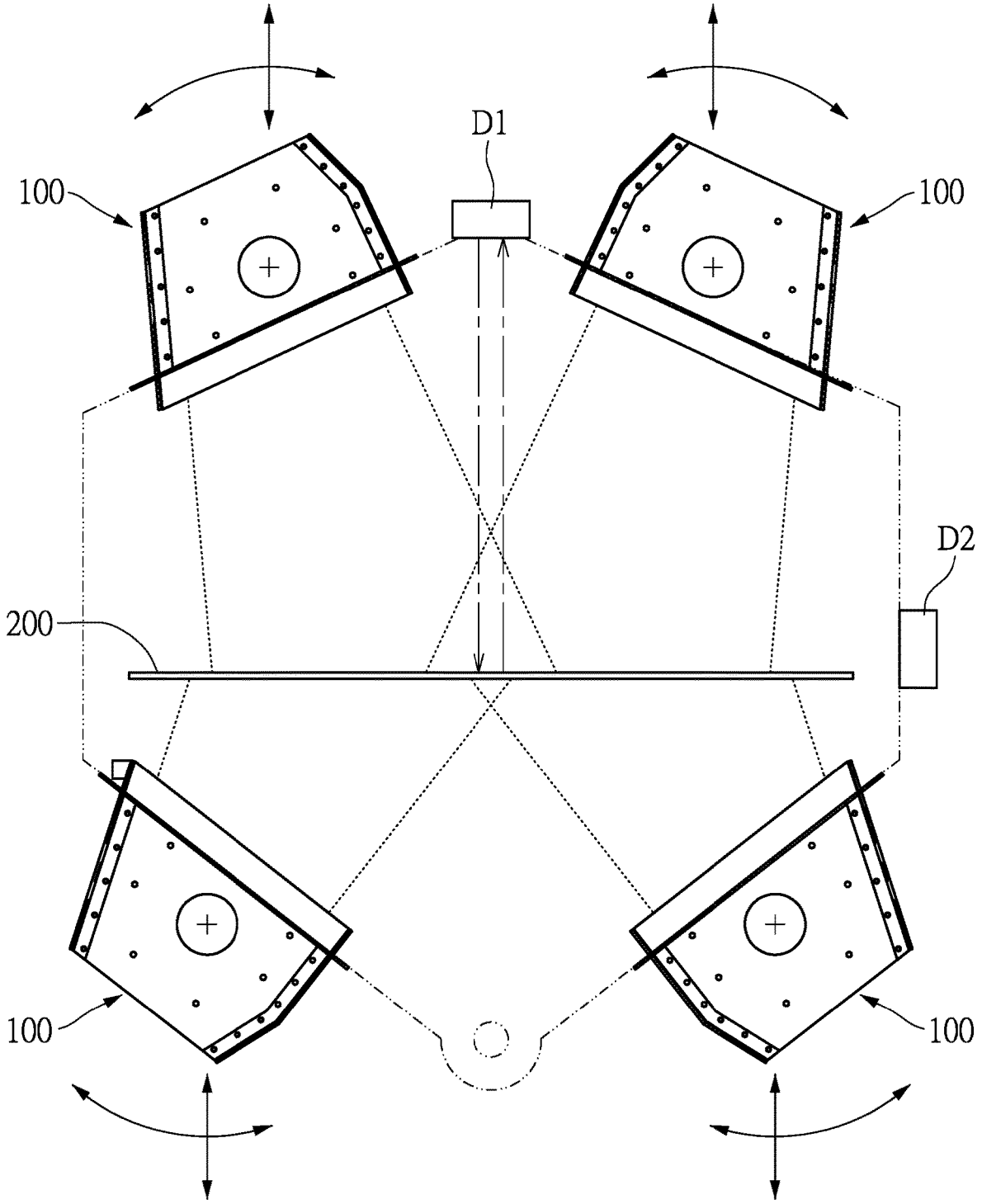
FIG. 5 is a schematic view of the blast-peening machine blast-peening the metal board in the present disclosure.

As shown in FIG. 5, in a more preferable implementation of the present embodiment, the blast-peening step S2 includes adjusting a blast-peening angle between the centrifugal impellers 100 and the metal board 200 or an automatic rotation of the nozzles of the centrifugal impellers 100, as shown by curved arrows in the left and right sides of FIG. 5. Therefore, the blast-peening granules are more evenly blast-peened on the metal board 200. In another implementation, the blast-peening step S2 further includes adjusting a distance between the nozzles of the centrifugal impellers 100 and the metal board 200. The distance between the nozzles of the centrifugal impellers 100 and the metal board 200 can be adjusted. Preferably, the implementation further includes providing a distance detection device D1 to detect distances between the nozzles of the centrifugal impellers 100 and the metal board 200. It should be noted that, during the adjustment of the blast-peening angle or distance, the centrifugal impellers 100 above and below the metal board 200 symmetrically blast-peen the metal board 200. In addition, each of the centrifugal impellers 100 includes a program-controllable motor, such that rotational speeds of the centrifugal impellers 100 may be adjusted.

Figure 6:
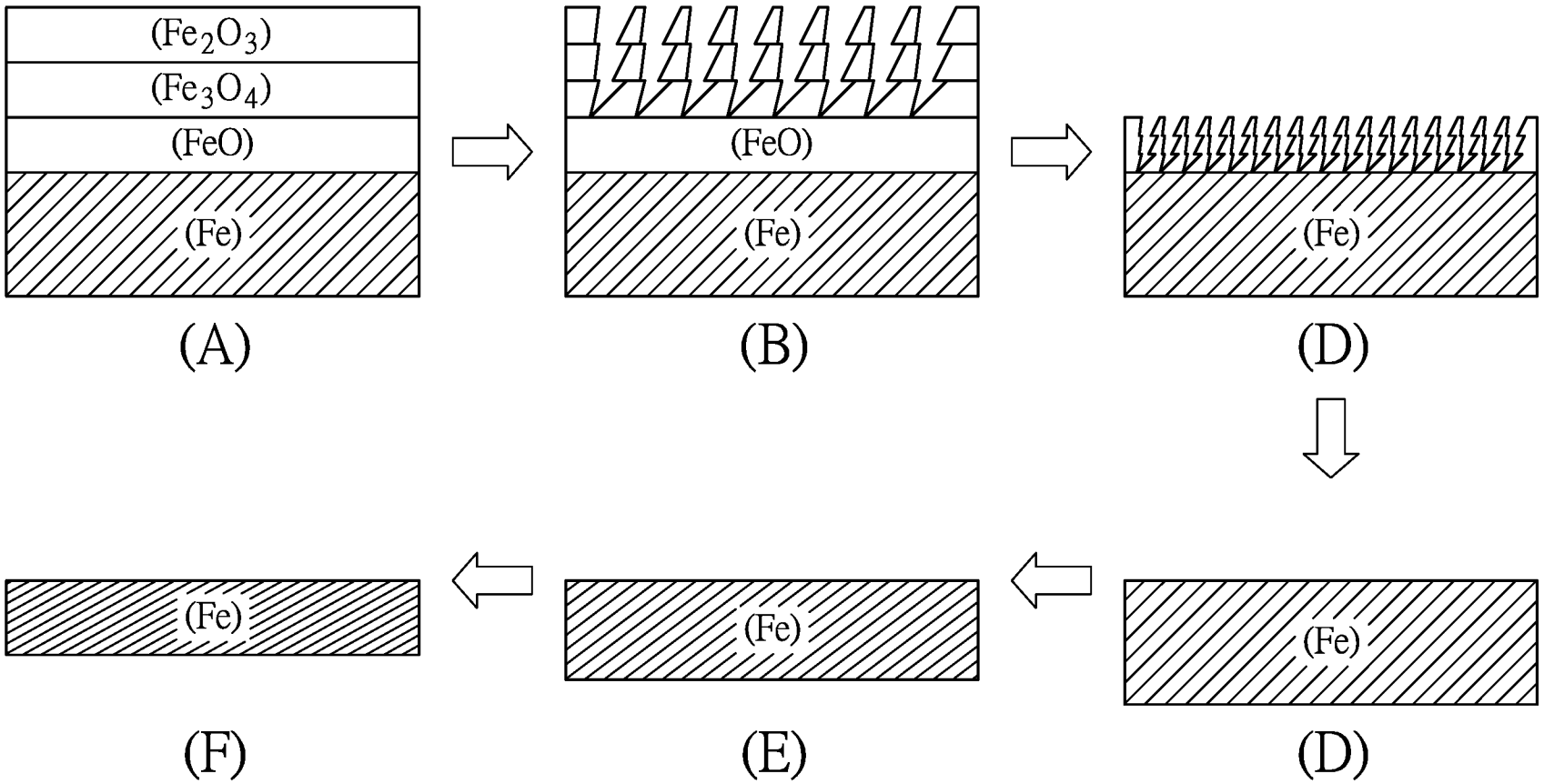
FIG. 6 shows microscopic views of stages of blast-peening the metal board in the present disclosure.

Reference is made to FIG. 6, which shows effects that can be achieved by the polygon blast-peening granules of the present disclosure. Microscopically speaking, phase (A) shows the untreated metal board 200; in phase (B), rust (i.e., $Fe_2O_3$, $Fe_3O_4$) of the metal board 200 is removed; in phase (C) and (D), the oxidized layer (i.e., FeO) is removed; in phase (E), the surfaces are homogenized; and in phase (F), deeper layers are homogenized. Through the above-mentioned blast-peening step S2, the present embodiment treats the surface of the metal board 200 through blast-peening the polygon blast-peening granules thereon, the cutting forces generated from blast-peening can remove the rust and the oxidized layer, and the impact forces generated from blast-peening can homogenize the surface of the metal board 200 and further homogenize the deep layers of the metal board 200. Therefore, the manner of blast-peening of the present embodiment can increase a surface hardness of the metal board 200.

The present embodiment is different from shot-peening of conventional technology, as shot-peening is unable to remove oxidized layer with a round granule. In conventional technology, before acid washing, in order to break down rust structure, some manners include using sandblasting or tension leveling machine forces to break down rust structures are applied, allowing heated acid wash solutions to permeate into a bottom layer of the metal board, such that the rust comes off and rust removal is achieved. Sandblasting has a slower speed and is unable to achieve the above-mentioned effects.

As shown in FIG. 1, a washing step S3 is then performed to wash the surface of the metal board 200, thereby removing powders generated from the blast-peening step S2.

As shown in FIG. 1, a phosphatizing step is then performed to form a phosphate coating on the surface of the metal board, so as to provide protection. In the present embodiment, the phosphatizing step includes using manganese phosphate solution, ferric phosphate solution or zinc phosphate solution, in which a pH of the manganese phosphate solution is preferably between 2 and 3 and a pH of the ferric phosphate solution is preferably between 3 and 5.5. Phosphatizing is a process using chemical and electrochemical reaction to form phosphate conversion coating, the phosphate conversion coating is suitable to be used on materials such as steel, aluminum or zinc, and the phosphate conversion coating formed is called phosphate coating. Phosphatizing is performed by dipping the metal board (or work piece) into phosphate solution (i.e., certain solutions mainly consisting acidic phosphates), and depositing a water-insoluble crystallized phosphate conversion coating on a surface of the metal board. The phosphate coating includes crystals that are light-reflective to a certain degree, gray, porous and have strong adhesion force. The crystals mostly include zinc phosphate, and some iron hydrogen phosphate. A ratio of zinc to iron depends on a content of the solution, phosphatizing time, and temperature. The goal of phosphatizing is to provide protection to the metal board, and prevent corrosion on metal from occurring. Phosphatizing can be used in applying a base coating before painting, such that the adhesion force and anti-corrosion capability of the paint coating are improved, and can provide lubrication that reduces friction in a metal cold processing technology. In the phosphatizing step of the present disclosure, no hydrogen permeation and remaining acid has occurred since acid washing was not performed in the preceding steps, such that the content of the phosphatizing solution is simple and the phosphatizing solution may be reused, and the only precipitate is iron slag that can be recycled and reused.

In addition, the phosphate coating cannot grow on a rust layer or oxidized layer, so that performing a thorough rust removal before phosphatizing is necessary. The previous step in the present disclosure, that is, the step of blast-peening the metal board is crucial. The rust removal cannot be excessively performed, otherwise the surface of the metal workpiece becomes rough, such that the crystals have a larger size and is porous, and precipitate is increased. Furthermore, if the rust removal is not thoroughly done, surface of the metal work piece lacks sufficient activation, and the crystal of the phosphate coating also has a larger size. As shown in FIG. 5, in the method for treating and phosphatizing a metal board without using acid in the present disclosure, a thickness of the oxidized layer removed in the blast-peening step S2 is greater than 10 μm. In addition, the method for treating and phosphatizing a metal board without using acid in the present disclosure further includes a surface real-time observation step, in which a detector D2 is used to detect a status of removing the oxidized layer from the surface of the metal board 200 in real-time, and when the powder generated from removing the oxidized layer show a characteristic in the air different from a characteristic from the beginning of the blast-peening step S2, the blast-peening step S2 is stopped. Therefore, removal of the oxidized layer can be precisely controlled to achieve adequate rust removal and adequate activation on the surface of the metal work piece, for subsequently forming a well-conditioned phosphate coating crystal.

As shown in FIG. 1, a washing step S5 is performed to wash off remaining phosphatizing agents from the metal board. The difference between this step and the previous washing step S3 is that, after phosphatizing, water is used to wash the phosphate coating to remove soluble substances adhered to the surface of the phosphate coating, thereby preventing bubbling or shedding from occurring on the phosphate coating under a condition of high humidity and temperature, such that the adhesion force and corrosion resistance of the phosphate coating is increased. The washing step S5 may be performed once or twice, and a step of drying the metal board may be performed afterwards.

As shown in FIG. 1, a rustproofing step S6 is performed to apply a rustproofing agent on the metal board. For example, the metal board can be dipped into rustproofing oil. The phosphate coating has many holes thereon, such that it cannot effectively prevent corrosion in the long term, specifically, when in contact with acidic or alkaline substances, the phosphate coating is easily damaged. Therefore, after the phosphatizing step, the metal board (or work piece) is required to be dipped into the rustproofing oil for rustproofing process. The rustproofing oil can form a dense rustproofing oil film at the surface of the metal work piece, thereby increasing the anti-corrosion capability of the metal work piece after phosphatizing.

Finally, a drying step S7 is performed to dry the metal board. In the present embodiment, air drying can be used in order to save energy, but the present disclosure is not limited thereto, and ventilation may be added or a heat drying process may be performed to increase the speed of drying.

In conclusion, in the method for treating and phosphatizing a metal board without using acid in the present disclosure, the pollution to the environment from acid wash solutions can be reduced by replacing a manner of removing oxidized layers of the metal work piece by acid washing with technical solutions of blast-peening. In the blast-peening step of the present disclosure, the blast-peening granule can be recycled and reused, thereby assisting in environmental protection. In addition, the angle and distance of blast-peening is preferably controllable in the present disclosure. Moreover, through the surface real-time observation step of the present disclosure, a detector D2 is used to detect a status of removing the oxidized layer from the surface of the metal board 200 in real-time, and when the powder generated from removing the oxidized layer show a characteristic in the air different from a characteristic from the beginning of the blast-peening step, the blast-peening step is stopped. Therefore, removal of the oxidized layer can be precisely controlled to achieve adequate rust removal and adequate activation on the surface of the metal work piece, allowing for subsequent forming of a well-conditioned phosphate coating crystal.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A method for treating and phosphatizing a metal board without using acid, comprising:

performing a degreasing step, wherein a degreasing agent is provided to remove grease and dirt from a surface of the metal board;

performing a blast-peening step by blasting and peening polygon blast-peening granules on the surface of the metal board through centrifugal impellers to remove an oxidized layer;

performing a washing step to wash the surface of the metal board, so as to remove powders generated from the blast-peening step;

performing a phosphatizing step to form a phosphate coating on the surface of the metal board, so as to provide protection;

performing another washing step to wash off remaining phosphatizing agents from the metal board;

performing a rustproofing step to apply a rustproofing agent on the metal board; and performing a drying step to dry the metal board;

wherein a speed of blast-peening the granules in the blast-peening step is from 50 to 200 meters per second, a material of the blast-peening granules is carborundum or silicon carbide, and a diameter of the blast-peening granules is from 320 to 1400 μm.

2. The method according to claim 1, wherein the blast-peening step includes providing a plurality of centrifugal impellers, the plurality of centrifugal impellers being arranged symmetrically at an upper surface and a lower surface of the metal board, respectively, and symmetrically performing blast-peening on the upper surface and the lower surface of the metal board.

3. The method according to claim 1, wherein the blast-peening step includes adjusting distances between nozzles of the centrifugal impellers and the metal board.

4. The method according to claim 3, further including providing a distance detector to detect the distances between the nozzles of the centrifugal impellers and the metal board.

5. The method according to claim 1, wherein the blast-peening step includes adjusting angles of blast-peening between nozzles of the centrifugal impellers and the metal board.

6. The method according to claim 1, wherein each of the centrifugal impellers includes a program-controllable motor, such that rotational speeds of the centrifugal impellers may be adjusted.

7. The method according to claim 1, wherein the phosphatizing step includes using manganese phosphate solution or zinc phosphate solution.

8. The method according to claim 1, wherein a thickness of the oxidized layer removed in the blast-peening step is greater than 10 μm.

9. A method for treating and phosphatizing a metal board without using acid, comprising:

performing a degreasing step, wherein a degreasing agent is provided to remove grease and dirt from a surface of the metal board;

performing a blast-peening step by blasting and peening polygon blast-peening granules on the surface of the metal board through centrifugal impellers to remove an oxidized layer;

performing a washing step to wash the surface of the metal board, so as to remove powders generated from the blast-peening step;

performing a phosphatizing step to form a phosphate coating on the surface of the metal board, so as to provide protection;

performing another washing step to wash off remaining phosphatizing agents from the metal board;

performing a rustproofing step to apply a rustproofing agent on the metal board;

performing a drying step to dry the metal board; and performing a surface real-time observation step, wherein a detector is used to detect a status of removing the oxidized layer from the surface of the metal board in real-time, and wherein, when detecting that the powder generated from removing the oxidized layer has a characteristic in the air that undergoes a change, the blast-peening step is stopped.

* * * * *